US008807737B2

(12) United States Patent
Thayer et al.

(10) Patent No.: US 8,807,737 B2
(45) Date of Patent: Aug. 19, 2014

(54) INKJET PRINTER HAVING AN IMAGE DRUM HEATER WITH HEATER SEALS

(75) Inventors: Bruce Earl Thayer, Spencerport, NY (US); Palghat S. Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 145 days.

(21) Appl. No.: 13/490,557

(22) Filed: Jun. 7, 2012

(65) Prior Publication Data

US 2013/0328983 A1 Dec. 12, 2013

(51) Int. Cl.
*B41J 2/01* (2006.01)

(52) U.S. Cl.
USPC ..... 347/103

(58) Field of Classification Search
USPC ..... 347/101–103, 108, 213; 399/69, 92, 96, 399/307
See application file for complete search history.

(56) References Cited

U.S. PATENT DOCUMENTS

| | | | | |
|---|---|---|---|---|
| 5,099,256 | A | 3/1992 | Anderson | |
| 5,502,476 | A * | 3/1996 | Neal et al. | 347/103 |
| 5,507,227 | A | 4/1996 | Frazer | |
| 5,532,722 | A | 7/1996 | Namiki et al. | |
| 6,713,728 | B1 | 3/2004 | Justice et al. | |
| 7,459,658 | B2 | 12/2008 | Hays et al. | |
| 7,682,014 | B2 | 3/2010 | Snyder et al. | |
| 7,725,050 | B2 | 5/2010 | Li et al. | |
| 7,860,418 | B2 | 12/2010 | VanKouwenberg et al. | |
| 7,971,987 | B2 * | 7/2011 | Godil et al. | 347/103 |

* cited by examiner

*Primary Examiner* — Hai C Pham
(74) *Attorney, Agent, or Firm* — Maginot, Moore & Beck, LLP

(57) ABSTRACT

An inkjet offset printer includes a heated drum assembly having a hollow drum with an internal surface defining an internal cavity and a heater located in the internal cavity. The heater includes a reflector having a seal, and at least one heating element configured to generate heat and disposed between the reflector and the internal surface of the drum. The seal contacts the internal surface of the hollow drum to confine the generated heat within a space defined by the reflector and the internal surface of the drum.

14 Claims, 8 Drawing Sheets

INKJET PRINTER HAVING AN IMAGE DRUM HEATER WITH HEATER SEALS

TECHNICAL FIELD

This disclosure relates generally to solid ink offset printers, and more particularly to rotating image receiving members that are heated to a temperature prior to and while receiving ink images.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving surface. In these solid ink printers, also known as phase change inkjet printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to a gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface can be the surface of a continuous web of recording media, a series of media sheets, or the surface of an image receiving member, which can be a rotating print drum or endless belt. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

Phase change inkjet printers form images using either a direct or an offset print process. In a direct print process, melted ink is jetted directly onto recording media to form images. In an offset print process, also referred to as an indirect print process, melted ink is jetted onto a surface of a rotating member such as the surface of a rotating drum, belt, or band. Recording media are moved proximate the surface of the rotating member in synchronization with the ink images formed on the surface. The recording media are then pressed against the surface of the rotating member as the media passes through a nip formed between the rotating member and a transfix roller. The ink images are transferred and affixed to the recording media by the pressure in the nip. This process of transferring an image to the media is known as a "transfix" process. The movement of the image media into the nip is synchronized with the movement of the image on the image receiving member so the image is appropriately aligned with and fits within the boundaries of the image media.

When the image receiving member is in the form of a rotating drum, the drum is typically heated to improve compatibility of the rotating drum with the inks deposited on the drum. The rotating drum can be, for example, an anodized and etched aluminum drum. A heater including a heater reflector or housing can be mounted axially within the drum and extends substantially from one end of the drum to the other end of the drum. A heater unit includes one or more heating elements located within the heater reflector with each one being located end to end along the length of the reflector. The heater remains stationary as the drum rotates. Thus, the heaters apply heat to the inside of the drum as the drum moves past the heating elements backed by the reflector. The reflector helps direct the heat towards the inside surface of the drum. Each of the heating elements is operatively connected to a controller which is configured to control the amount of power applied to the heating elements for generating heat. The controller is also operatively connected to temperature sensors located near the outside surface of the drum. The controller selectively operates the heater to maintain the temperature of the outside surface within an operating range.

In one embodiment, the controller is configured to operate the heater in an effort to maintain the temperature at the outside surface of the drum in a range of about 55 degrees Celsius, plus or minus 5 degrees Celsius. The ink that is ejected onto the print drum has a temperature of approximately 110 to approximately 120 degrees Celsius. Thus, images having areas that are densely pixelated, can impart a substantive amount of heat to a portion of the print drum. Additionally, the drum experiences convective heat losses as the exposed surface areas of the drum lose heat as the drum rapidly spins in the air about the heater. Also, contact of the recording media with the print drum affects the surface temperature of the drum. For example, paper placed in a supply tray has a temperature roughly equal to the temperature of the ambient air. As the paper is retrieved from the supply tray, it moves along a path towards the transfer nip. In some printers, this path includes a media pre-heater that raises the temperature of the media before it reaches the drum. These temperatures can be approximately 40 degrees Celsius. Thus, when the media enters the transfer nip, areas of the print drum having relatively few drops of ink on them are exposed to the cooler temperature of the media. Consequently, densely pixilated areas of the print drum are likely to increase in temperature, while more sparsely covered areas are likely to lose heat to the passing media. These differences in temperatures result in thermal gradients across the print drum.

Efforts have been made to control the thermal gradients across a print drum for the purpose of maintaining the surface temperature of the print drum within the operating range. Simply turning the heater on and off can be insufficient because the ejected ink can raise the surface temperature of the print drum above the operating range, even when an individual heating element is turned off. In some cases cooling is provided by adding a fan at one end of a print drum. The print drum is open at each flat end of the drum. To provide cooling, the fan is located outside the print drum and is oriented to blow air from the end of the drum at which the fan is located to the other end of the drum where it is exhausted. The fan is electrically operatively connected to the controller so the controller activates the fan in response to one of the temperature sensors detecting a temperature exceeding the operating range of the print drum. The air flow from the fan eventually cools the overheated portion of the print drum at which point the controller deactivates the fan.

While the fan system described above can generally maintain the temperature of the drum within an operating range, some inefficiencies do exist. Specifically, one inefficiency can arise when the surface area at the end of the print drum from which the air flow is exhausted has a higher temperature than the surface area near the end of the print drum at which the fan is mounted. In response to the detection of the higher temperature, the controller activates the fan. As the cooler air enters the drum, it absorbs heat from the area near the fan that is within the operating range. This cooling can result in the controller turning on the heater for that region to keep that area from falling below the operating range. Even though the air flow is heated by the region near the fan and/or the heating element in that area, the air flow can eventually cool the overheated area near the drum end from which the air flow is exhausted. Nevertheless, the energy spent warming the region near the fan and the additional time required to cool the overheated area with the warmed air flow from the fan adds to the operating cost of the printer. Thus, improvements to printers to heat and to cool a print drum are desirable.

SUMMARY

A heated drum assembly for use in a printer includes a heater having a seal to direct heat to an internal surface of an imaging drum and to confine the heat to a space defined by the heater and the drum. The heated drum assembly includes a hollow drum having an internal surface defining an internal cavity. A heater is located in the internal cavity. The heater includes a reflector having at least one wall with a seal disposed at one end of the wall and at least one heating element configured to generate heat. The heater is disposed between the reflector and the internal surface of the drum. The seal contacts the internal surface of the hollow drum to confine the generated heat within a space defined by the at least one wall and the internal surface of the drum.

A printer includes an image receiving member and a heater disposed within the image receiving member. The heater includes a seal configured to direct and confine heat generated by the heater within a space defined by the heater, the seal and the image receiving member. The printer includes an image receiving member having a substantially cylindrical outer surface and an internal surface defining an internal cavity. A heater located in the internal cavity heats the internal surface of the image receiving member. The heater includes a seal wherein the seal contacts the internal surface to substantially confine the heat within a space defined by the housing and the internal surface of the drum. A printhead deposits ink on the image receiving member and is disposed adjacent to the image receiving member. A controller is operatively connected to the heater. The controller is configured to control the amount of heat generated by the heater in a warm-up mode, a standby mode and in a print mode.

BRIEF DESCRIPTION OF THE DRAWINGS

The foregoing aspects and other features of an inkjet printer rotating image receiving member that is heated to a predetermined temperature prior to and during the receipt of images are explained in the following description, taken in connection with the accompanying drawings.

DETAILED DESCRIPTION

Figure 1:
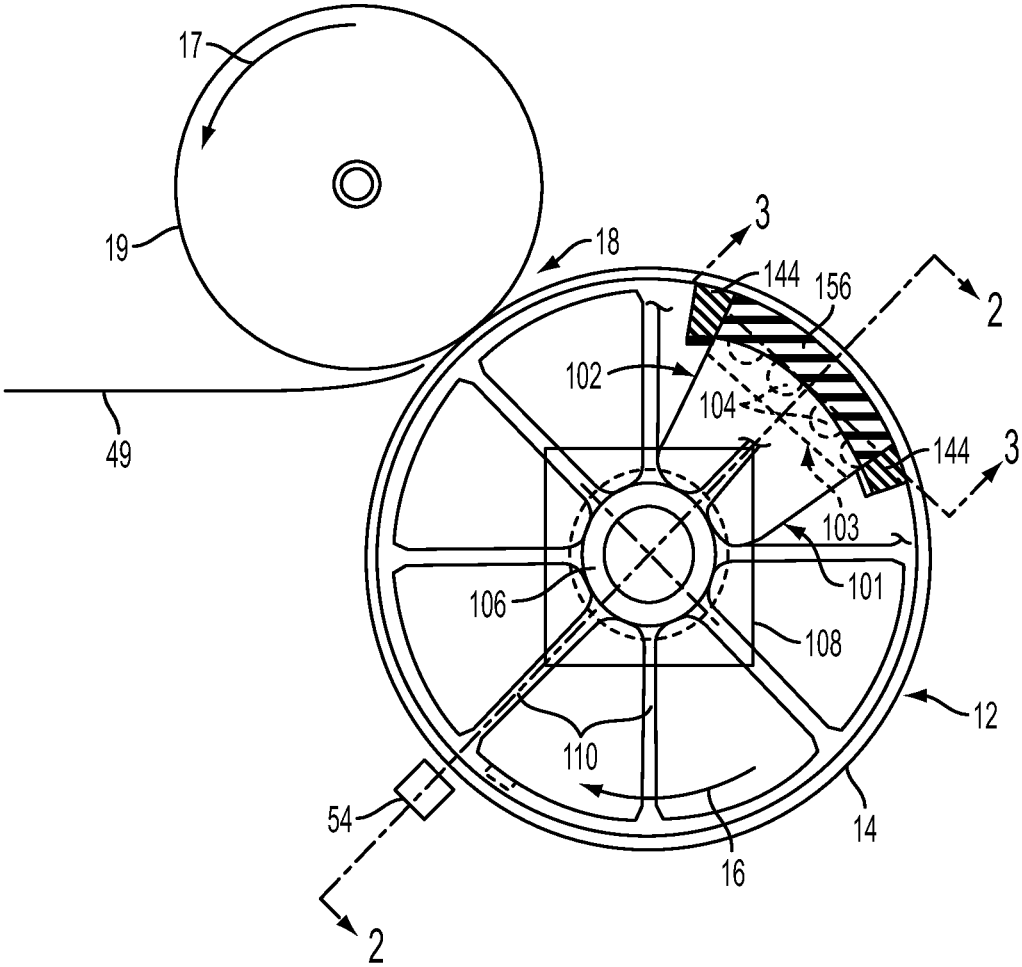
FIG. 1 is a side view of a portion of a printer including a transfix roller defining a nip with an image receiving member.

For a general understanding of the environment for the system and method disclosed herein as well as the details for the system and method, reference is made to the drawings. In the drawings, like reference numerals have been used throughout to designate like elements. As used herein the term "printer" refers to any device that produces ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various recording media including paper.

Figure 9:
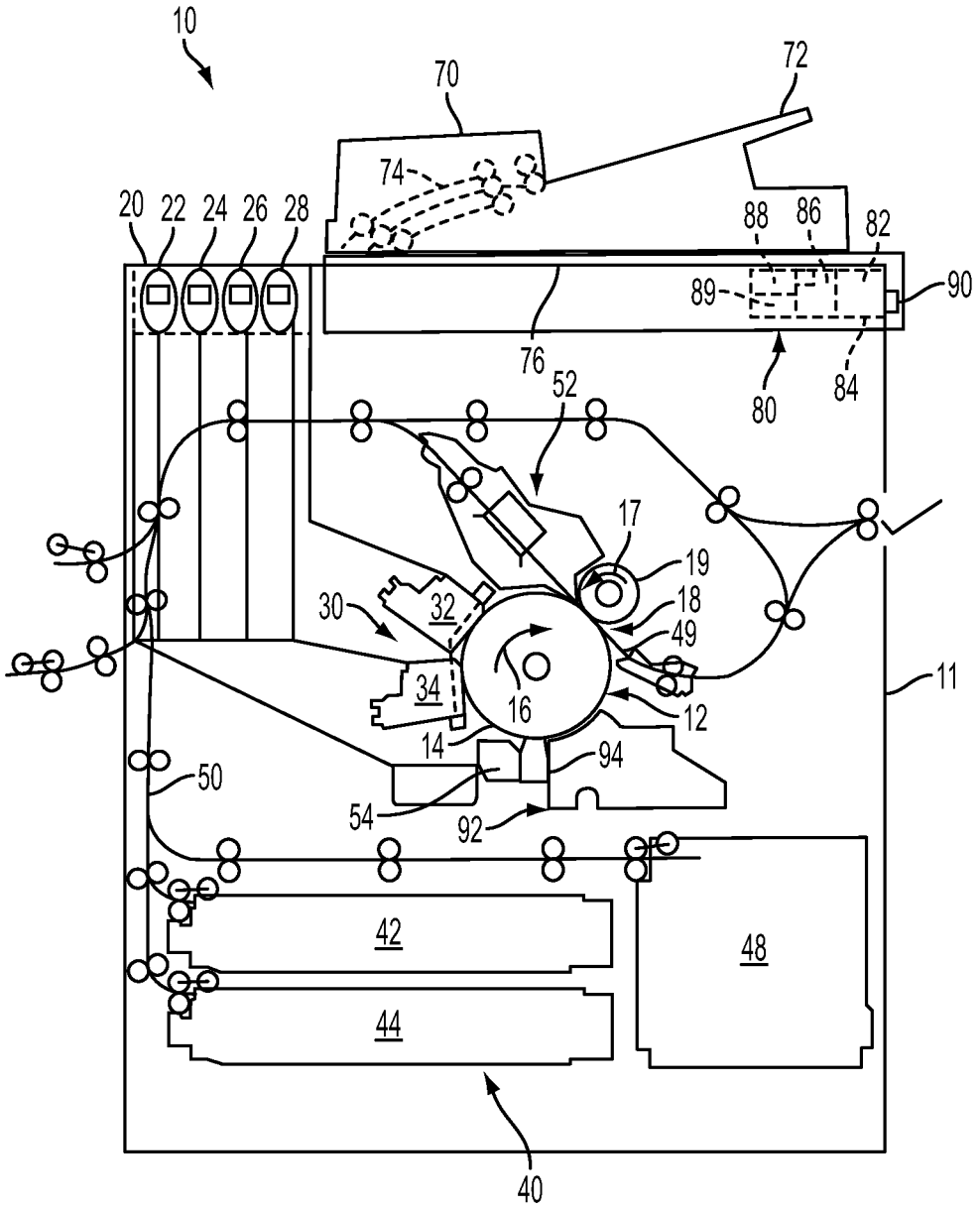
FIG. 9 PRIOR ART
FIG. 9 is a schematic view of an inkjet printer configured to print images onto a rotating image receiving member and to transfer the images to the recording media.

FIG. 9 illustrates a prior art high-speed phase change ink image producing machine or printer 10. As illustrated, the printer 10 includes a frame 11 supporting directly or indirectly operating subsystems and components, as described below. The printer 10 includes an image receiving member 12 that is shown in the form of a drum, but can also include a supported endless belt. The image receiving member 12 has an imaging surface 14 that is movable in a direction 16, and on which phase change ink images are formed. A transfix roller 19 rotatable in the direction 17 is loaded against the surface 14 of drum 12 to form a transfix nip 18, within which ink images formed on the surface 14 are transfixed onto a recording media 49, such as heated media sheet.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Each printhead assembly 32 includes at least one printhead configured to eject ink drops onto the surface 14 of the image receiving member 12 to produce an ink image thereon. Since the phase change ink printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies can be one or any number greater than two.

As further shown, the phase change ink printer 10 includes a recording media supply and handling system 40, also known as a media transport. The recording media supply and handling system 40, for example, can include sheet or substrate supply sources 42, 44, 48, of which supply source 48, for example, is a high capacity paper supply or feeder for storing and supplying image receiving substrates in the form of cut media sheets 49, for example. The recording media supply and handling system 40 also includes a substrate handling and treatment system 50 that has a substrate heater or pre-heater assembly 52. The phase change ink printer 10 as shown can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead assemblies 32, 34 (and thus the printheads), and the substrate supply and handling system 40. The ESS or controller 80, for example, is a self-contained, dedicated mini-computer having a central processor unit (CPU) 82 with electronic storage 84, and a display or user interface (UI) 86. A temperature sensor 54 is operatively connected to the controller 80. The temperature sensor 54 is configured to measure the temperature of the image receiving member surface 14 as the image receiving member 12 rotates past the temperature sensor 54. In one embodiment, the temperature sensor is a thermistor that is configured to measure the temperature of a selected portion of the image receiving member 12. The controller 80 receives data from the temperature sensor and is configured to identify the temperatures of one or more portions of the surface 14 of the image receiving member 12.

The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multitasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, associated memories, and interface circuitry configure the controllers to perform the processes that enable the printer to perform heating of the image receiving member, depositing of the ink, and DMU cycles. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. Additionally, pixel placement control is exercised relative to the imaging surface 14 thus forming desired images per such image data, and receiving substrates, which can be in the form of media sheets 49, are supplied by any one of the sources 42, 44, 48 and handled by recording media system 50 in timed registration with image formation on the surface 14. Finally, the image is transferred from the surface 14 and fixedly fused to the image substrate within the transfix nip 18.

In some printing operations, a single ink image can cover the entire surface of the imaging member 12 (single pitch) or a plurality of ink images can be deposited on the imaging member 12 (multi-pitch). Furthermore, the ink images can be deposited in a single pass (single pass method), or the images can be deposited in a plurality of passes (multi-pass method). When images are deposited on the image receiving member 12 according to the multi-pass method, under control of the controller 80, a portion of the image is deposited by the printheads within the printhead assemblies 32, 34 during a first rotation of the image receiving member 12. Then during one or more subsequent rotations of the image receiving member 12, under control of the controller 80, the printheads deposit the remaining portions of the image above or adjacent to the first portion printed. Thus, the complete image is printed one portion at a time above or adjacent to each other during each rotation of the image receiving member 12. For example, one type of a multi-pass printing architecture is used to accumulate images from multiple color separations. On each rotation of the image receiving member 12, ink droplets for one of the color separations are ejected from the printheads and deposited on the surface of the image receiving member 12 until the last color separation is deposited to complete the image.

In some cases for example, cases in which secondary or tertiary colors are used, one ink droplet or pixel can be placed on top of another one, as in a stack. Another type of multi-pass printing architecture is used to accumulate images from multiple swaths of ink droplets ejected from the print heads. On each rotation of the image receiving member 12, ink droplets for one of the swaths (each containing a combination of all of the colors) are applied to the surface of the image receiving member 12 until the last swath is applied to complete the ink image. Both of these examples of multi-pass architectures perform what is commonly known as "page printing." Each image comprised of the various component images represents a full sheet of information worth of ink droplets which, as described below, is then transferred from the image receiving member 12 to a recording medium.

In a multi-pitch printing architecture, the surface of the image receiving member is partitioned into multiple segments, each segment including a full page image (i.e., a single pitch) and an interpanel zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image or images have been printed on the image receiving member 12 under control of the controller 80 in accordance with an imaging method, such as the single pass method or the multi-pass method, the exemplary inkjet printer 10 converts to a process for transferring and fixing the image or images at the transfix roller 19 from the image receiving member 12 onto a recording medium 49. According to this process, a sheet of recording medium 49 is transported by a transport under control of the controller 80 to a position adjacent the transfix roller 19 and then through a nip formed between the movable or positionable transfix roller 19 and image receiving member 12. The transfix roller 19 applies pressure against the back side of the recording medium 49 in order to press the front side of the recording medium 49 against the image receiving member 12. In some embodiments, the transfix roller 19 can be heated.

A pre-heater for the recording medium 49 is provided in the media path leading to the nip. The pre-heater provides the necessary heat to the recording medium 49 for subsequent aid in transfixing the image thereto, thus simplifying the design of the transfix roller. The pressure produced by the transfix roller 19 on the back side of the heated recording medium 49 facilitates the transfixing (transfer and fusing) of the image from the image receiving member 12 onto the recording medium 49.

The rotation or rolling of both the image receiving member 12 and transfix roller 19 not only transfixes the images onto the recording medium 49, but also assists in transporting the recording medium 49 through the nip formed between them. Once an image is transferred from the image receiving member 12 and transfixed to a recording medium 49, the transfix roller 19 is moved away from the image receiving member 12. The image receiving member 12 continues to rotate and, under the control of the controller 80, any residual ink left on the image receiving member 12 is removed by drum maintenance procedures performed at a drum maintenance unit (DMU) 92.

The DMU 92 can include a release agent applicator 94, a metering blade, and, in some embodiments, a cleaning blade. The release agent applicator 94 can further include a reservoir having a fixed volume of release agent such as, for example, silicone oil, and a resilient donor roll, which can be smooth or porous and is rotatably mounted in the reservoir for contact with the release agent and the metering blade. The DMU 92 is operably connected to the controller 80 such that the donor roll, metering blade and cleaning blade are selectively moved by the controller 80 into temporary contact with the rotating image receiving member 12 to deposit and distribute release agent onto and remove un-transferred ink pixels from the surface of the member 12.

The primary function of the release agent is to prevent the ink from adhering to the image receiving member 12 during transfixing when the ink is being transferred to the recording medium 49. The release agent also aids in the protection of the transfix roller 19. Small amounts of the release agent are transferred to the transfix roller 19 and this small amount of release agent helps prevent ink from adhering to the transfix roller 19. Consequently, a minimal amount of release agent on the transfix roller 19 is acceptable.

The image receiving member 12 has a tightly controlled surface that provides a microscopic reservoir capacity to hold the release agent. Too little release agent present in areas or over the entire image receiving member prevents transfer of the ink pixels to the recording media 49. Conversely, too much release agent present on the image receiving member 12 results in transfer of some release agent to the back side of the recording media 49. If the recording media 49 is then printed on both sides in duplex printing, some of the ink pixels may not adhere properly to the second side of the recording media 49. To combat these image defects, each DMU cycle selectively applies and meters release agent onto the surface of the image receiving member 12 by bringing the donor roller and then the metering blade of the release agent applicator 94 into contact with the surface of the image receiving member 12 prior to subsequent printing of images on the image receiving member 12 by the printheads in assemblies 32, 34. These actions replenish the release agent to the reservoir on the surface of the image receiving member 12 to prevent image failure and ensure continued application of a uniform layer of release agent to the surface of the image receiving member 12.

FIG. 1 is a side view of a portion of the printer 10 including the image receiving member 12, with the imaging surface 14 rotating in the direction 16, and the transfix roller 19 rotating in the direction 17. The image receiving member 12 includes a heater 102 including a support structure 101 configured to support a reflector 103 and one or more heating elements 104. The heater 102 remains fixed as drum 12 rotates past the heater 102. The heater 102 generates heat that is absorbed by the inside surface of the drum 12 to heat the image receiving surface of the drum as it rotates past the heater. A cooling system for the drum 12 includes a hub 106 that is preferably centered about the longitudinal center line of the image receiving member 12. A fan 108 is mounted outboard of the hub 106 and oriented to direct aft flow through the drum. A temperature sensor 54 is located proximate the outer surface of the drum 12 to detect the temperature of the drum surface as it rotates.

Each end of the drum 12 can be open at the hub 106 operatively connected to a plurality of spokes 110 as shown in FIG. 1. The hub 106 can be provided with a pass through for passage of electrical wires to the heater(s) within the drum. Additionally, the hub has a bearing at its center so the drum can be rotatably mounted in a printer. The spokes 110 extend from the hub 106 to support the cylindrical wall of the drum 12 and to provide airways for aft circulation within the drum 12. The heater 102 that heats the drum 12 can be a convective or radiant heater. In one embodiment, the fan 108 can produce air flow in the range of approximately 45-55 cubic feet per minute (CFM) of air flow, although other airflow ranges can be used depending upon the thermal parameters of a particular application. The temperature sensor 54 can be any type of temperature sensing device that generates an analog or digital signal indicative of a temperature in the vicinity of the sensor. Such sensors include, for example, thermistors or other junction devices that predictably change rn some electrical property in response to the absorption of heat. Other types of sensors include dissimilar metals that bend or move as the materials having different coefficients of temperature expansion respond to heat.

Figure 2:
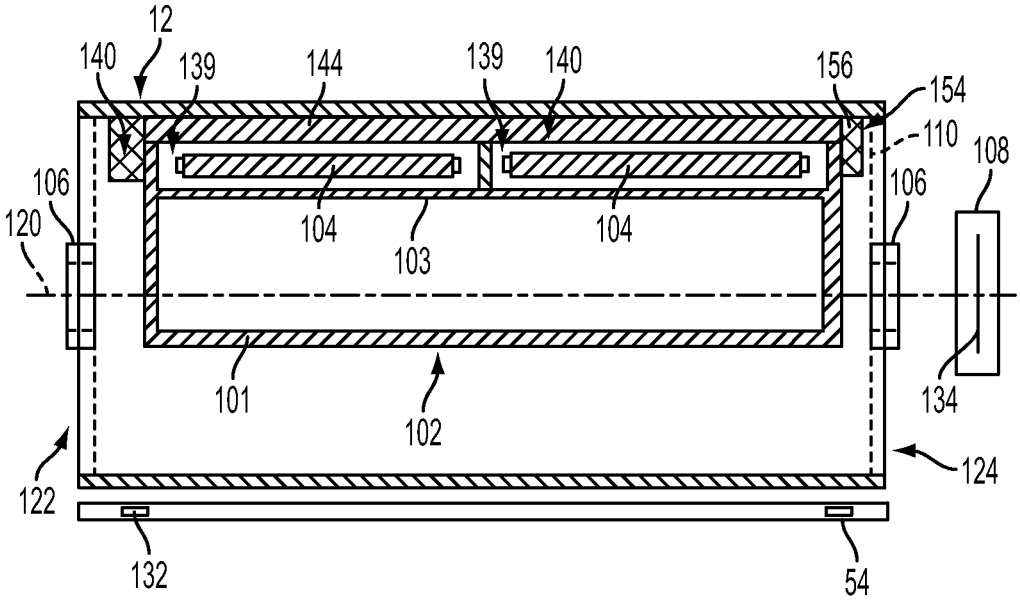
FIG. 2 is a cross-sectional view of the image receiving member of FIG. 1 along a line 2-2.

A cross-sectional view of the drum 12 along the line 2-2 of FIG. 1 is shown in FIG. 2. The drum 12 has a longitudinal axis 120 running through the center of the hub 106 at a first end 122 and through the center of the hub 106 at a second end 124. The voids between the spokes 110 at each end of the drum 12 facilitate aft flow through the drum 12. The heater elements 104 are mounted within the reflector 103. Also, a second temperature sensor 132 is mounted proximate the first end 122 to sense the temperature near the first end of the drum 12. Additional temperature sensors can be mounted about the drum 12, however the temperature sensors are preferably mounted in a linear arrangement along the longitudinal axis 120 as shown in FIG. 2. Although the temperature sensors are shown as being located near the ends of the drum 12, they can be located closer towards the center of the drum.

The signals from sensors 54, 132 can be analog signals that are digitized by an A/D converter, which is interfaced to the controller 80. The controller 80 receives temperature values from the temperature sensors 54, 132 and compares those values to thresholds using programmed instructions. In one embodiment, the two temperature values can be compared to one another to determine which one is greater. The controller 80 can be configured to detect whether one or both of the temperatures are greater than a threshold. If only one is greater than a threshold, then the controller 80 operates the fan 108 to move air from the warmer end through the drum to the cooler end. If both temperatures exceed the threshold, the controller operates the fan to move air in a predetermined direction. The predetermined direction corresponds to air flow from the drum end that is closest to significant thermal generators, such as ink melters, electronic assemblies, or motors. Once the operation of the fan results in one of the temperatures falling below the threshold, the controller operates the fan to blow from the end still exceeding the threshold.

Fan 108 is a bi-directional fan. That is, the direction of rotation for a fan blade 134 can be controlled by an appropriate signal to the fan. When the blade 134 rotates in one direction, air flows from fan 108 through the drum 12 for exhausting at end 122. When the blade 134 rotates in an opposite direction, air flows from end 122 for exhausting at end 124. In a similar manner, fan 108 can be a DC fan and the polarity of the supply voltage to the fan determines the direction of fan blade rotation and the direction of the air flow through the drum 12. Thus, a bi-directional fan can provide two directions of air flow through the drum 12 with a single fan. The advantage of a bi-directional fan is that the blade of such fans is shaped so the air flow is approximately the same regardless of the direction in which the bade is timing. A DC muffin fan does not necessarily have a fan blade that produces the same air flow in each direction. Consequently, air flow in one direction can be greater than air flow in the other direction.

As further illustrated in FIG. 2, the reflector 103 includes a seal 140 which extends from a portion of the reflector 103 to the internal surface of the drum 12. The seal 140 extends around a perimeter of the reflector 103, as illustrated in FIG. 3, to substantially enclose a space defined within the reflector 103 and the internal surface of the drum 12.

Figure 3:
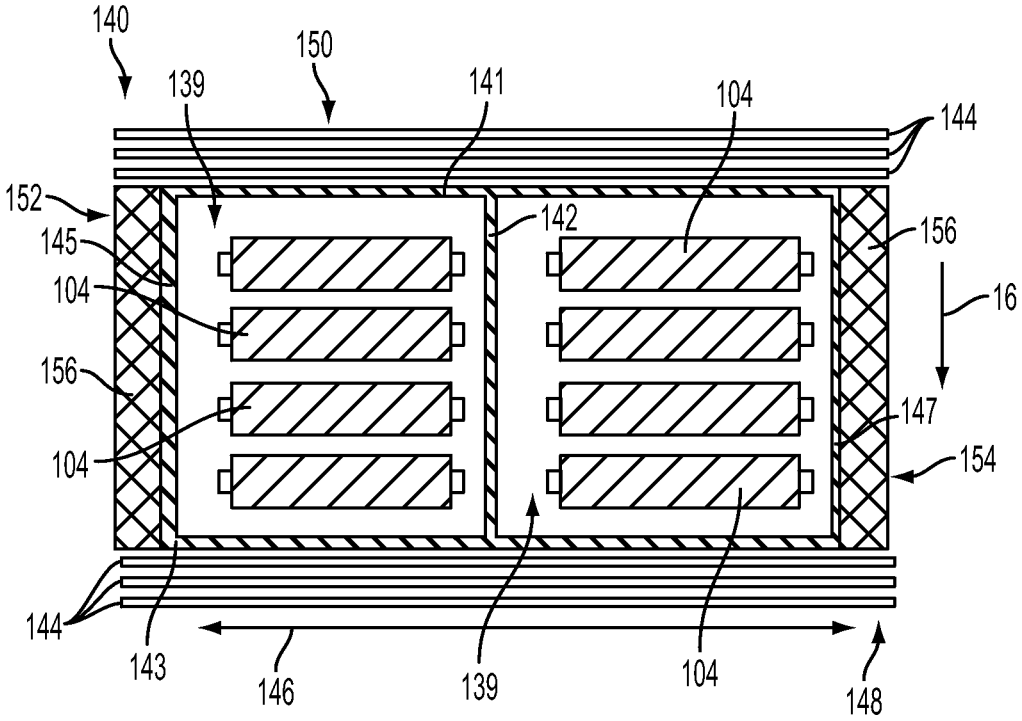
FIG. 3 is a cross-sectional view of the image receiving member of FIG. 1 along a line 3-3.

Heating elements 104 of FIG. 2 are further illustrated in FIG. 3. The reflector 103 includes a central divider 142 to provide support for the reflector 103 as well as to divide the space within the reflector 103. Other dividers can be included, or the divider 142 can be eliminated. In one embodiment, the reflector 103 includes at least one wall with the seal disposed at the end of the wall. As illustrated in FIG. 3, the at least one wall includes a first side wall 141, a second side wall 143, a first end wall 145, and a second end wall 147, each being operatively connected to provide a housing defining a space to confine the generated heat. A bottom wall (not shown) is operatively connected to the first and second side walls 141 and 143 and the first and second end walls 145 and 147 to define a substantially enclosed space to direct heat toward the internal surface of the drum. In one embodiment, each of the walls can include an individual panel operatively connected to the seal, where the seal can be one continuous element operatively connected to each of the panels. The seal can also include a number of singular and distinct seals, one for each individual panel. In another embodiment, a seal or seals can be operatively connected to each of the walls 141, 143, 145, and 147 and to the central divider 142. If the divider 142 or other internal walls are included, each can include a seal specific to the divider 142 or internal walls. By isolating one heater element from another heating element, segmented heating can be provided by turning on and/or off separate heater elements to thereby direct heat to only certain portions of the drum.

In one embodiment, individual panels can be formed of mica arranged and operatively connected together to form the reflector 103. A reflective material can be associated with the mica and placed within the space or spaces 139, defined by the reflector, to direct heat provided by the elements 104 to the internal surface of the drum 12. In another embodiment, each of the walls can be formed of a single piece of material, such as plastic, where a panel portion is thicker than a seal portion. The seal portion tapers from the wall portion to a contacting portion that contacts the internal surface of the drum. In this configuration, the seal portion can comprise a vane having sufficient flexibility to deform under the pressure of contact with the internal surface of the drum.

As illustrated in FIG. 3, the seal 140 includes a plurality of vanes 144 extending from the upper portion of the reflector 130 into contact with the drum 12. In the illustrated embodiment, the vanes 144 extend along a line 146 from approximately the end 122 to the end 124 of the drum 12. The vanes 144 at a side 148 and at a side 150 run substantially the entire axial length of the drum 12. The vanes 144 include a substantially linear edge to contact the internal surface of the drum which passes across the vanes 144 in the direction 16.

The seal 140 at an end 152 and an end 154 of the reflector 103 extends from the upper portion of the reflector and contacts the internal surface of drum 12 to substantially prevent the generated heat from escaping the ends of the reflector 103. The seal 140 at the ends 152 and 154 can include a material such as felt or foam 156 including a surface defined to interface with the internal surface of the drum 12. The surface can define a radius substantially the same as the radius defined by the internal surface of the drum to provide seal at each of the ends 152 and 154 to retain heat within the reflector 103.

The vanes 144 that extend from edges of the reflector 102 along the longitudinal axis of the drum 12 and the felt seals 140 located at the ends 152 and 154 substantially enclose the spaces 139 defined by the housing 102. Consequently, the heat generated by the heating elements 104 is held within the space or spaces 139 to direct the generated heat to the portions of the drum sealed with the housing.

While FIGS. 2 and 3 illustrate that the seal 140 can include vanes 144 disposed along the longitudinal axis of the drum 14 and felt or foam material disposed in the direction of rotation 16 of the drum 12 other types and combinations of seals can be used. For instance, the entire seal 140 can comprise a material such as foam or felt, or the entire seal 140 can comprise a plurality of vanes. In other embodiments as illustrated in FIGS. 4A-4F, the seals can include a number of different types of material and configurations.

Figure 4A:
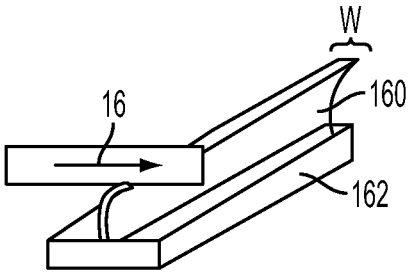
FIGS. 4A-4G illustrates a partial perspective view of a plurality of different seals.

FIG. 4A illustrates a seal 140 including a wiper seal having a single vane 160 operatively connected to a vane support 162. As the drum 12 rotates in the direction 16, the vane 160 which contacts the internal surface (not shown) of the drum 12 is bent in the direction of rotation 16 with contact to the drum 12, since the drum rotates with respect to the fixed heater 102. In this embodiment, the vane support 162 is configured to operatively connect to the edges of the housing of the heater 102. The vane support 162 can include a channel, for instance, to which the edge of the housing can be inserted.

The vane support 162 can be permanently operatively connected to the housing with an adhesive or can be configured to include mating features which cooperate with mating features of the housing. The vane 160 includes a width W which is sufficiently wide to provide sufficient resiliency to remain in contact with the drum 12.

Figure 4B:
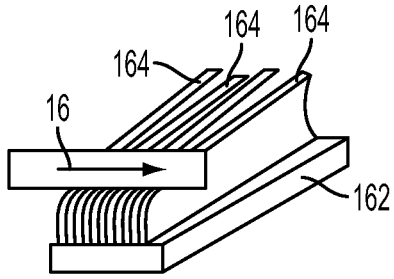
Figure 4C:
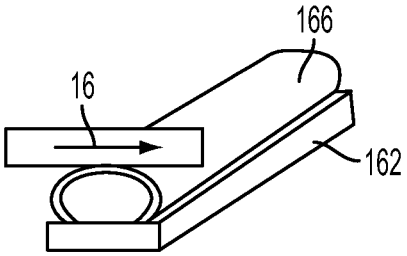
Figure 4D:
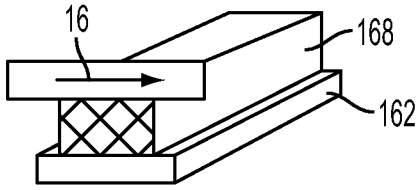
Figure 4E:
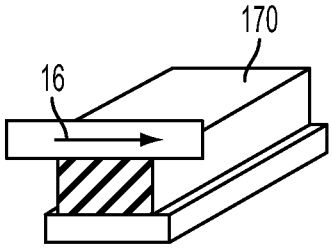
Figure 4F:
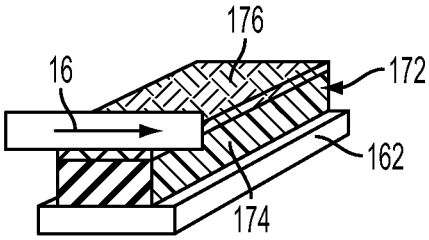
Figure 4G:
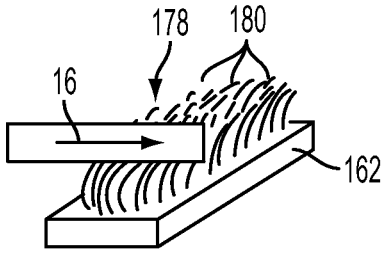

FIGS. 4B-4G illustrate additional embodiments of a seal 140 each of which includes a support 162 as described with respect to FIG. 4A. Each of the supports can include a connecting portion adapted to operatively connect the seal to the edges of panels included in the walls of the housing. FIG. 4B illustrates a plurality of vanes 164 operatively connected to the support 162. FIG. 4C illustrates an extruded tubular seal or tube 166 operatively connected to the support 162. FIG. 4D illustrates a felt seal 168 operatively connected to the support 162. FIG. 4E illustrates a foam seal 170 operatively connected to the support 162. FIG. 4F illustrates a faced foam seal 172 operatively connected to the support 162. The faced foam seal 172 includes a foam base 174 operatively connected to the support 162 and a facing 176 operatively connected to the foam base 174 to contact the internal surface of the drum 102. The facing 176 can be made of plastic or other deformable material, including foam having a density that is different than the foam base 174. FIG. 4G illustrates a brush seal 178 operatively connected to the support 162. The brush seal 178 includes a plurality of bristles or fibers 180. As described with respect to the embodiment of FIG. 4A, each of the embodiments of FIGS. 4B to 4G, provides a seal with the internal surface of the drum 12. Each embodiment includes the characteristic of being deformable when compressed. The seals should have sufficient interference with the drum surface such that air flow into and out of the heater cavity is substantially inhibited. In addition, the seals should be formed of a material which enables the drum 12 to rotate against the fixed location of the seals without excessive drag or friction developing between the seals and the interior surface of the drum 12.

Solid ink jet printers having an imaging drum require a certain amount of power to maintain a proper operating temperature of the surface of the drum. If the proper operating temperature is not maintained image defects can occur as described above. In a standby mode the image drum is held at operational temperature or slightly below if the drum can be heated quickly enough to satisfy customer expectations. In a sleep mode, the drum can be held at even lower temperatures, but a longer warm-up time is required to return to printing temperatures. A cold print process (printing at 45° C. instead of 55° C.) can be used to enable quicker warm-up, but productivity and image quality can be reduced and certain print jobs cannot be started until a normal printing temperature is reached. Current and future regulatory requirements and customer desires to conserve energy indicate that solid inkjet printer energy usage should be reduced.

The seals attached to the periphery of the heater housing inside the image drum can inhibit or prevent the air flow into and out of the heater cavity. When warmed from a cold state, a heater with seals warms faster than a heater without seals. The image drum, however, does not warm faster with a sealed heater. After the drum has reached operating temperature and completed printing jobs, the heater waits for the next printing job in the standby mode. Less power is required for a sealed heater in standby mode than for a heater without seals. Consequently, image drum standby power is reduced. In one embodiment, power savings of approximately 13-17 watts or more can be obtained in standby mode. Because a significant amount of time can be spent in standby mode, this power savings can significantly reduce the total energy consumption of the machine.

The seal material should withstand the elevated temperature of the drum and the nearby heater cavity. Drum temperatures are typically less than 70 degrees centigrade and the seals can be largely shielded from direct exposure to the heater cavity and radiation from the heater element. In addition, the inside of the drum is smooth and the contact force of the seals is low. Consequently, a variety of seal materials are possible. Seal materials can include nylon, polypropylene, acrylic, rubber, polyester, wool felt, polyurethane and many thin metal sheets. The seal material should also have long wearing properties.

The sealed heater housing requires less power to maintain a steady state temperature than an unsealed heater. The seals restrict heated air from leaving and cooler air from entering the heater cavity. By limiting heat losses from the drum heater cavity, the heater requires less power to maintain a heater temperature necessary to achieve the desired steady state standby temperature drum temperature.

Figure 5:
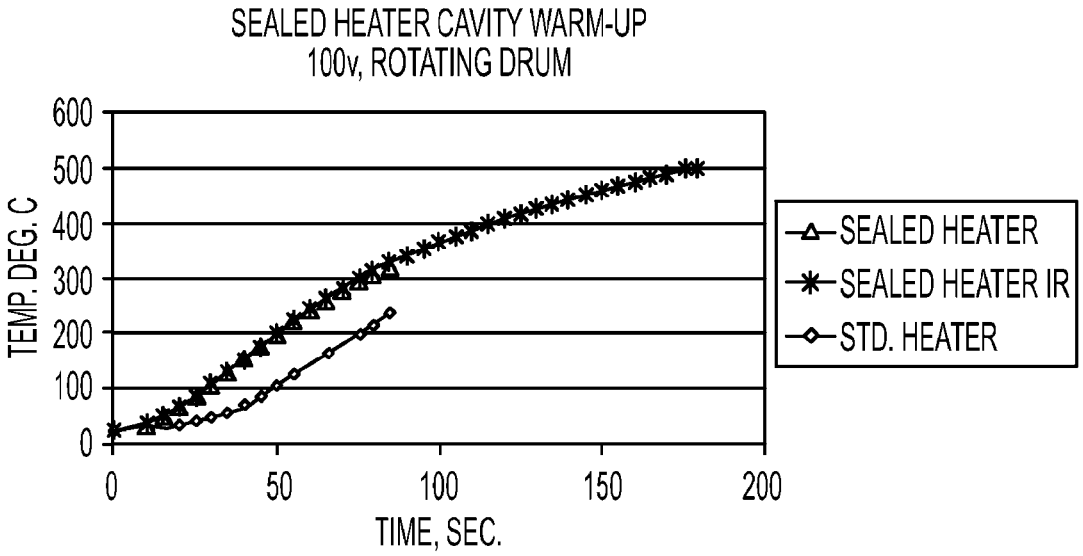
FIG. 5 is a graph of a change in temperature over time for a sealed heater cavity.

FIG. 5 illustrates a graph of an increase in heater cavity temperature for a heater having seals over time. The graph shows heater cavity temperature as a function of time when the heater is warmed up from room ambient temperature. The temperature inside the heater cavity rises faster when heater seals are installed. This demonstrates that heat losses occur when air is allowed to be exchanged between the heater cavity and the inside of the image drum.

Figure 6:
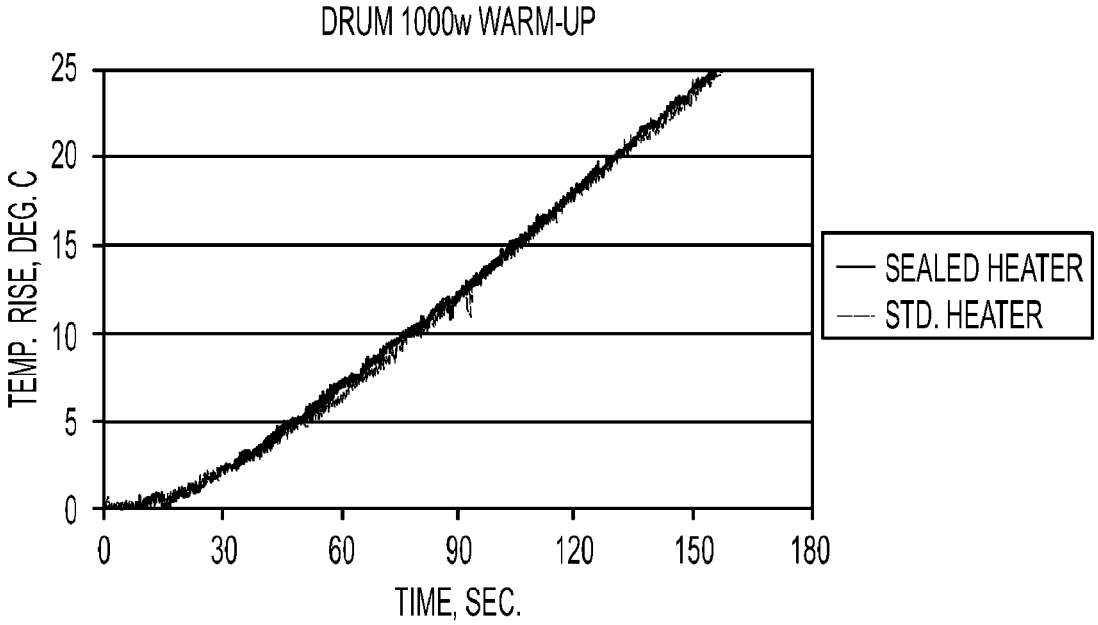
FIG. 6 is a graph of a change in temperature over time for a drum having a sealed heater and a drum having an unsealed heater.

FIG. 6 illustrates a graph of a rise in image drum temperature from room ambient temperature for a standard unsealed heater and a sealed heater over time. As illustrated, the warm-up curves are the same, showing that drum temperature does not heat up more quickly with a sealed heater. While the heater cavity temperature with seals is higher that the heater cavity temperature without seals, the warm-up time for drum temperature is substantially the same. Because no increase drum warm-up rate occurred when heater seals are used and the heater cavity was hotter, it follows that convective heat transfer to the image drum is insignificant when compared to radiation heat transfer. During drum warm-up the resistance wires (Nichrome) reach temperatures of approximately 800° C.

Figure 7:
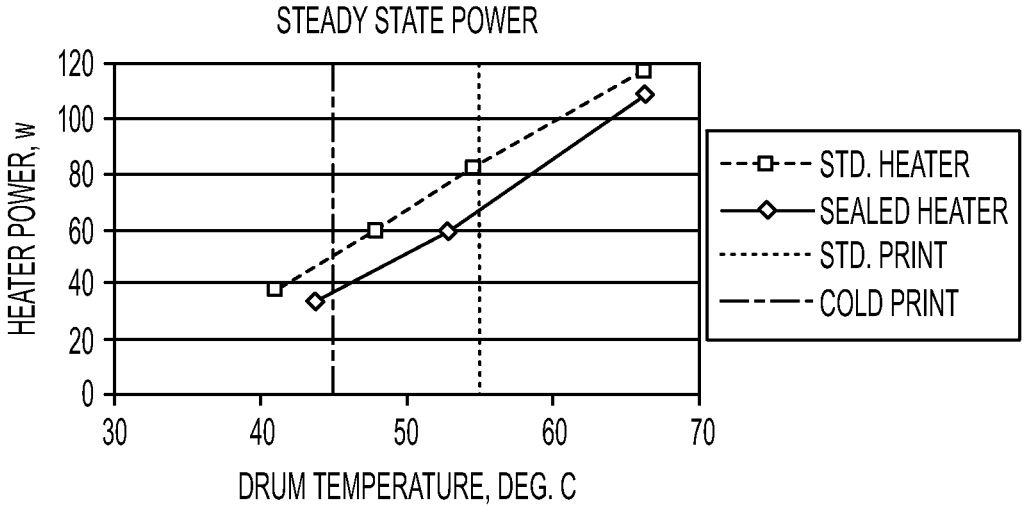
FIG. 7 is a graph of a change in heater power versus drum temperature for a drum having a sealed heater and a drum having an unsealed heater.

FIG. 7 illustrates a graph of a change in heater power versus drum temperature for a drum having a sealed heater and a drum having an unsealed heater. As shown, a sealed heater requires less power to maintain a standby steady state drum temperature than is required for an unsealed heater. Steady state drum temperatures are shown for four different standard, unsealed heater power inputs and three different sealed heater power inputs. A standard unsealed heater requires about 84 watts to maintain a 55° C. drum temperature and about 50 watts to maintain a 45° C. drum. With a sealed heater, about 67 watts is required to maintain a 55° C. drum and about 37 watts is required to maintain a 45° C. drum. At a drum temperature of 55° C., the heater wire temperature is about 300° C. To hold the drum temperature at 45° C., the heater wire temperature is in the range of 200° C. to 250° C. Unlike during drum warm-up, standby mode convective heat transfer to the drum surface is more significant relative to radiation heat transfer with lower heater wire temperatures. The required power is also less since the convective heat losses from the heater wires without heater seals are a greater portion of the heater input power at lower wire temperatures than at higher wire temperatures. By sealing the heater, heat losses can be reduced and the drum can be kept at the desired standby temperature with lower heater input power.

For a sealed heater, the temperature of the air inside the heater cavity can be substantially different than the outside ambient air. As the air temperature inside the drum cavity increases, the convective heat loss from the heater wires to the air decreases. Consequently, overall heater power at steady state is reduced. This effect is likely small during warm-up where the air temperature in the cavity is closer to the outside ambient air and the convective losses account for only a very small fraction of the overall heater power.

Figure 8:
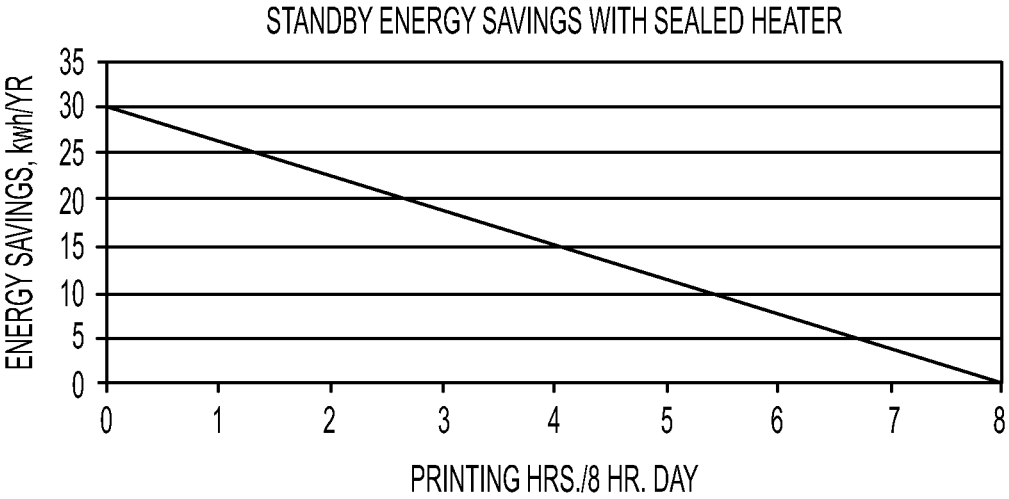
FIG. 8 is a graph of energy savings versus printing time in an eight hour day for a printer having a drum with a sealed heater.

FIG. 8 illustrates a potential energy savings based on the number of hours per day of printing for the condition where the printer is print ready eight hours per day and in sleep mode the rest of the day, for a work week of 5 days per week, and a work year of 50 weeks per year. A power reduction of about 20% to 25% in a single inkjet printer having a sealed heater can be obtained. In particular, the power reduction can occur at the standard operating temperature (55° C.) and at the cold print process operating temperature (45° C.). Even more energy savings are possible if the drum is kept warm during sleep mode. Total energy savings can be significant because a solid ink jet printer can be in standby mode for a large portion of the time the power is on. Consequently, customers can reduce the amount of energy needed for printing operations, thereby reducing operating expenses for printers.

It will be appreciated that several of the above-disclosed and other features, and functions, or alternatives thereof, can be desirably combined into many other different systems or applications. For instance, the described embodiments can be used in printers where a rotating roller is heated and particularly where a heated roller is held at a standby temperature between uses. For instance, applications can include spreader rolls, fuser rolls, dryer rolls and other heated nip rollers used in printing applications. In addition, seals can also be used where there is no relative motion between the heater and the drum internal surface in an embodiment where the heater is fixed with respect to the drum. In that configuration, other types and designs of a seal not appropriate for relative motion can also be used. Various presently unforeseen or unanticipated alternatives, modifications, variations, or improvements therein can be subsequently made by those skilled in the art, which are also intended to be encompassed by the following claims.

What is claimed is:

1. A heated drum assembly for use in a printer, the drum assembly comprising:

a hollow drum including an internal surface defining an internal cavity; and a heater located in the internal cavity, the heater including:

a reflector having a first side wall, a second side wall, a first end wall and a second end wall, each of the first and second side walls and the first and second end walls being operatively connected to provide a housing that defines a space to confine heat, each of the first and second side walls and the first and second end walls includes a panel having an end;

at least one seal operatively connected to the ends of the panels with the seal extending from the panels to contact the internal surface of the hollow drum and substantially span a gap between the panels and the internal surface of the hollow drum to confine heat within the space defined by the housing, the seal being deformable with applied pressure; and at least one heating element disposed between the reflector and the internal surface of the hollow drum to generate heat within the space.

2. The heated drum assembly of claim 1, the at least one seal further comprising:

a first seal operatively connected to the first side wall that has a first configuration; and a second seal operatively connected to the first end wall that has a second configuration that is different than the first configuration of the first seal.

3. The heated drum assembly of claim 2 wherein the first configuration defines a substantially linear edge and the second configuration defines a curve adapted to contact a curvature of the internal surface of the drum.

4. The heated drum assembly of claim 1, the at least one seal further comprising:

a connecting portion adapted to operatively connect the at least one seal to the edges of the panels of the first and second side wall and the first and second end walls.

5. The heated drum assembly of claim 1, the at least one seal further comprises one of a wiper, a brush and a tube.

6. The heated drum assembly of claim 1, the at least one seal further comprises a material including one of a plastic, a rubber, a metal, a foam, and a felt.

7. The heated drum assembly of claim 1 wherein the panel and the seal comprise the same material.

8. The heated drum assembly of claim 1, wherein the panel and the seal being comprised of different materials.

9. A printer comprising:

an image receiving member including a substantially cylindrical outer surface and an internal surface defining an internal cavity;

a heater that includes a housing having a first side wall, a second side wall, a first end wall and a second end wall operatively connected to one another to provide the housing and a space within the housing, each of the first and second side walls and the first and second end walls include a panel having an end, the heater being located in the internal cavity to heat the internal surface of the image receiving member;

a seal operatively connected to each end of each panel of the first and second side walls and the first and second end walls, the seal contacts the internal surface to substantially confine heat within the space defined by the housing and the internal surface of the image receiving member, the seal being deformable with applied pressure;

a printhead, to deposit ink on the image receiving member, the printhead disposed adjacent to the image receiving member; and a controller, operatively connected to the heater, the controller being configured to control an amount of heat generated by the heater in a warm-up mode, a standby mode and in a print mode.

10. The printer of claim 9, the seal further comprises one of a wiper, a brush, and a tube.

11. The printer of claim 9, the seal further comprises a material including one of plastic, rubber, metal, foam, and felt.

12. The printer of claim 9, the heater further includes at least two heating elements; and the housing further includes a divider separating one of the at least two heating elements from another of the at least two heating elements.

13. The printer of claim 12 wherein the seal is operatively connected to the divider.

14. The printer of claim 9 wherein the image receiving member is rotatably supported by a hub and the heater is fixedly located with respect to the hub.

* * * * *